US008216079B1

(12) United States Patent
Brunetti

(10) Patent No.: US 8,216,079 B1
(45) Date of Patent: Jul. 10, 2012

(54) GOLF CLUB TRAINING IMPLEMENT

(75) Inventor: Gardner Brunetti, Easley, SC (US)

(73) Assignee: Frogger, LLC, San Mateo, CA (US)

( * ) Notice: Subject to any disclaimer, the term of this patent is extended or adjusted under 35 U.S.C. 154(b) by 0 days.

(21) Appl. No.: 13/051,121

(22) Filed: Mar. 18, 2011

(51) Int. Cl.
*A63B 69/36* (2006.01)

(52) U.S. Cl. ..... 473/206; 473/409

(58) Field of Classification Search ..... 473/201, 473/204, 205, 206, 219, 226, 298, 299, 300, 473/302, 303, 409, 551
See application file for complete search history.

(56) References Cited

U.S. PATENT DOCUMENTS 1,587,287 A 6/1926 Denman
1,692,201 A 11/1928 Denman et al.
3,951,416 A 4/1976 Koch et al.
5,163,685 A * 11/1992 Rhodes ..... 473/206
5,704,845 A 1/1998 Boyte
6,152,831 A * 11/2000 Arcenas ..... 473/206
7,081,053 B2 * 7/2006 Kallassy ..... 473/204
7,128,656 B1 * 10/2006 Orchel ..... 473/205
7,725,956 B1 6/2010 Berokoff
7,931,541 B2 * 4/2011 Rhodes ..... 473/201

* cited by examiner

*Primary Examiner* — Nini Legesse
(74) *Attorney, Agent, or Firm* — Charter IP LLC; Matthew J. Lattig

(57) ABSTRACT

A golf club training implement is described which includes a tapered sleeve having a first end, a tapered second end, and a longitudinal slit opening therein so that the implement fits over a shaft of a club for slidable placement on or along a golf club grip. A substantially circular guard is attached to and abuts the sleeve first end. The guard is oriented at an angle relative to the sleeve first end so that the sleeve has a longer first side and an opposite shorter second side between the sleeve first and second ends.

10 Claims, 7 Drawing Sheets

GOLF CLUB TRAINING IMPLEMENT

BACKGROUND

1. Field

The example embodiment in general relates to a golf training implement, more particularly, to an anti-slip implement designed for attachment and use on a golf club grip.

2. Related Art

One of the primary causes of poor golf play is a poor golf grip. Many golfers tend to grip their clubs too tightly, which generally causes a slice swinging motion resulting in poor play and scoring. A poor grip can result from many factors. A lack of experience can result in fear that a golf club will slip out of one's hand. A desire to hit the ball as hard as possible often results in gripping the club too tightly. Moreover, mere frustration can cause a golfer to over-grip.

SUMMARY

An example embodiment is directed to a golf club training implement. The implement includes a tapered sleeve having a wider diameter at a first end and a smaller diameter at a tapered second end, the tapered sleeve configured to slidably fit along a golf club grip. The sleeve has a longitudinal slit opening so that the implement is fitted over a narrower portion of a golf club lower shaft and moved up along the shaft's length until secured on the golf club grip. The implement includes a substantially circular guard portion attached at the sleeve first end, the slit opening also extending therethrough, with the guard portion encircling the golf club grip. The guard portion is oriented at an angle relative to the sleeve first end so that the sleeve has a longer first side along the grip and an opposite shorter second side along the grip between the sleeve first and second ends to substantially prevent slippage of the golf club from a golfer's grip.

Another example embodiment is directed to a method of fabricating a golf club training implement. The method includes forming a tapered sleeve having a wider diameter at a first end and a smaller diameter at a tapered second end, forming a longitudinal slit opening in the sleeve, where the formed tapered sleeve with longitudinal slit is configured to be fitted over a portion of a golf club shaft and slidably fit along a golf club grip, and forming a substantially circular guard portion on the sleeve first end. In forming the guard portion, a slit opening is formed therein that is aligned with the longitudinal slit opening in the sleeve; the formed guard portion being configured to encircle the golf club grip. Additionally to form the guard portion, it is oriented at an angle relative to the sleeve first end so that the formed sleeve with guard portion thereon has a longer first side and an opposite shorter second side between the sleeve first and second ends.

Another example embodiment is directed to a golf club training implement having a tapered sleeve with a first end, a tapered second end, and a longitudinal slit opening therein so that the implement fits over a shaft of a club for slidable placement on or along a golf club grip. The implement includes a substantially circular guard attached to and abutting the sleeve first end. The guard is oriented at an angle relative to the sleeve first end so that the sleeve has a longer first side and an opposite shorter second side between the sleeve first and second ends.

BRIEF DESCRIPTION OF THE DRAWINGS

The example embodiment will become more fully understood from the detailed description given herein below and the accompanying drawings, wherein like elements are represented by like reference numerals, which are given by way of illustration only and thus are not limitative of the example embodiment herein.

DETAILED DESCRIPTION

As to be shown hereafter, the example embodiment is directed to a non-intrusive golf training implement that is easily applied to a standard golf club for enabling golfers to relax their grip, thereby promoting a better grip on a golf club. Additionally, the example embodiment may improve a golfer's grip to prevent club slippage from worn older grips, sweaty hands, playing in the rain, or mere lack of grip resulting from medical conditions such as arthritis. Moreover, it will be shown how the example embodiment enables a golfer to more easily relax their grip while choking-up on a golf club for certain shots.

The example embodiment provides a golf training implement and method of use therefor to promote proper grip on standard golf clubs. Referring now to FIGS. 1A to 1D, implement 10 is illustrated in four different orientations.

Figure 1A:
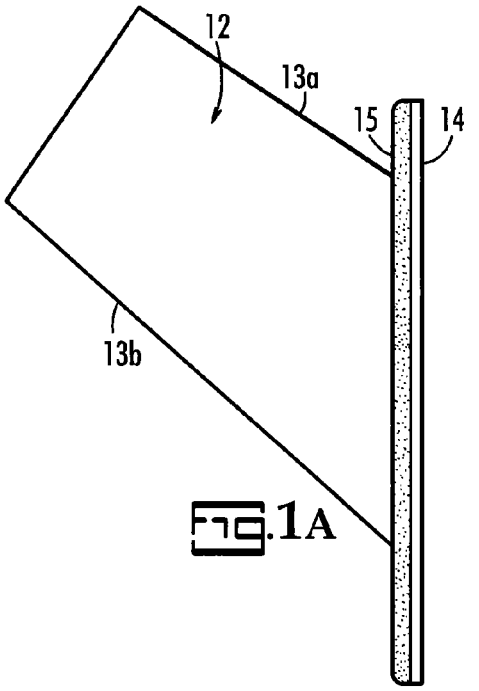
FIG. 1A illustrates an outer side view of a golf training implement according to the example embodiment.

FIG. 1A illustrates implement 10 from side view where tapered sleeve portion 12 is shown connected to circumferential guard portion 14 from an outside view. A first portion or first length side (such as an upper portion 13*a*) of tapered sleeve 12 is shorter than a second portion or second length side opposite the first side (such as an opposite lower portion 13*b* thereof) to simultaneously provide the proper angle of circumferential guard 14 and the proper length and width of tapered sleeve 12 so as to operably fit upon the upper portion of a golf club grip. FIG. 1B illustrates a cross-section of implement 10 so that an inner portion 12*a* of the tapered sleeve 12 is visible as it relates to an inner portion 14*a* of the circumferential guard.

Figure 1C:
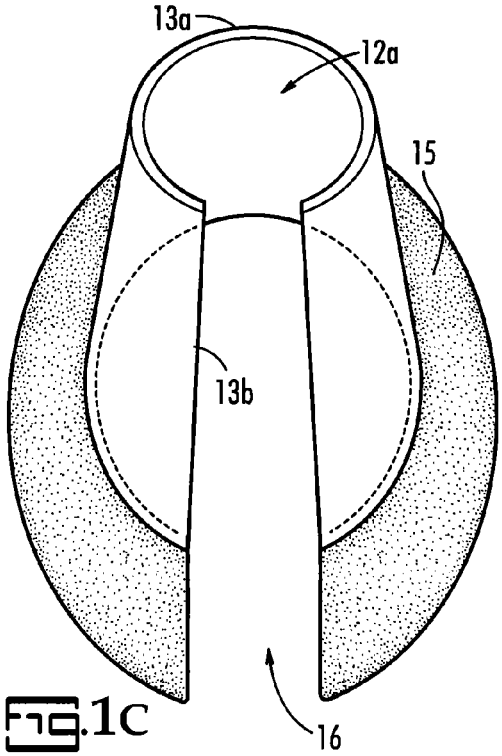
FIG. 1C illustrates an upper side view of the implement.
Figure 1B:
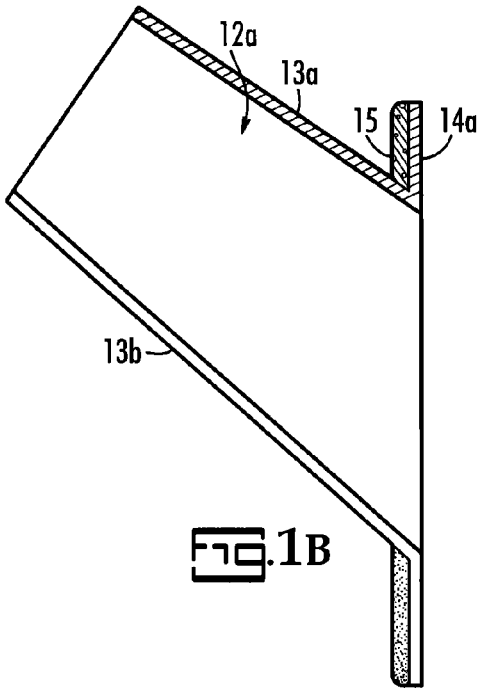
FIG. 1B illustrates an inner side view of the implement.
Figure 1D:
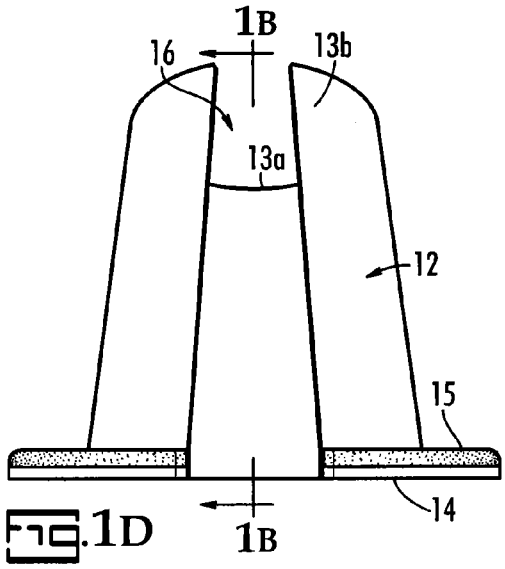
FIG. 1D illustrates an outer side view of the implement.

FIG. 1C illustrates implement 10 from an upper side view where the inner portion 12*a* of tapered sleeve 12 is visible, along with the outer portion of the circumferential guard 14. Optional padding 15 can be included on the outer surface of circumferential guard 14 for comfort and to further aid the anti-slip function of implement 10. Opening 16 along the entire length of tapered sleeve 12 is provided to facilitate installation of implement 10 upon a golf club. FIG. 1D illustrates implement 10 in an upright position with circumferential guard portion 14 resting on a flat surface. The tapered shape of sleeve 12 is designed to substantially match the shape and dimensions of a standard golf club grip. From this perspective, the shorter length of upper portion 13*a* (first side) is distinguishable from the longer, opposite lower portion 13*b* (second side). The unequal length sides of tapered sleeve 12, which are created by the angled circumferential guard 14 attached thereto as shown in FIGS. 1A and 1B for example, are necessary to fit implement 10 snugly over the contours of a standard golf grip.

Figures 2A, 2B:
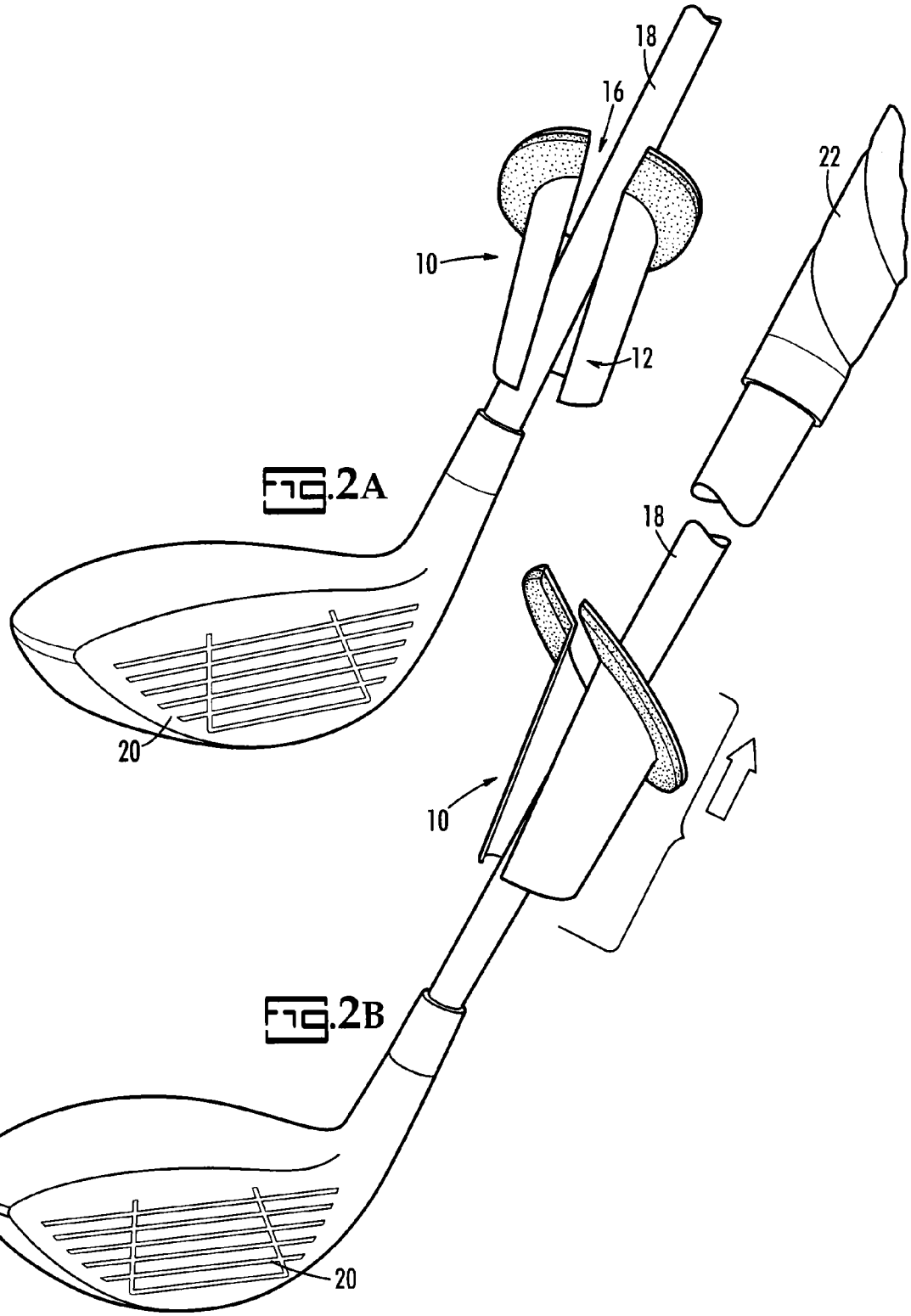
FIG. 2A illustrates installation of the golf training implement onto a shaft of a golf club according the example embodiment.
FIG. 2B illustrates movement of the shaft toward the club grip.

Referring now to FIGS. 2A and 2B, the process of attaching implement 10 for use on a standard golf club is illustrated. A user begins by slipping implement 10 over a narrow portion 18 of a standard golf club. The narrow portion 18 is generally closest to club head 20 where the club shaft in thinnest. Implement 10 is slipped over narrow portion 18 by sliding the club shaft through opening 16 until the general c-shape of implement 10 encompasses the club shaft as shown in FIG. 2A.

Figure 3A:
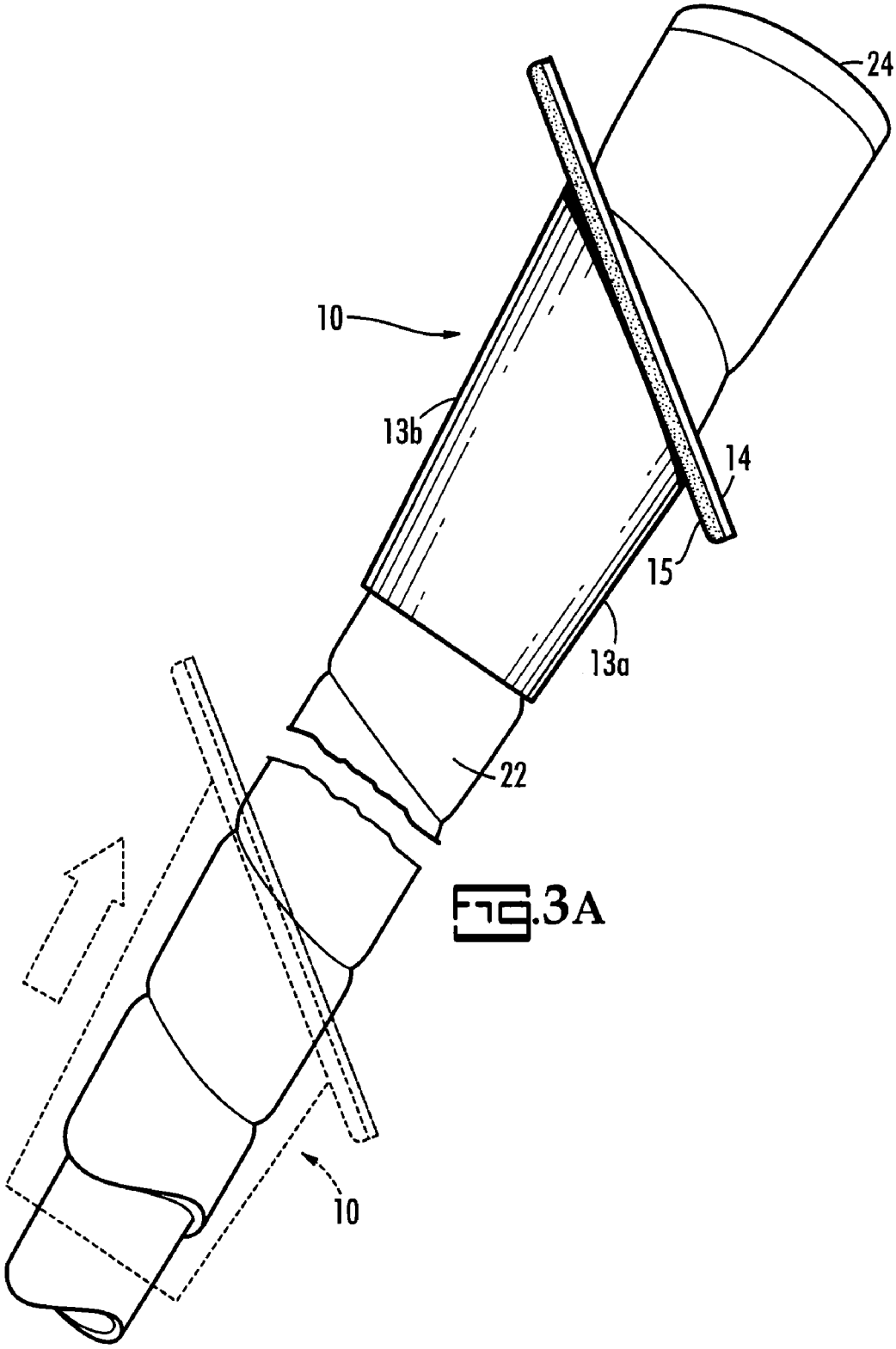
FIG. 3A illustrates placement of the implement on the grip in one configuration.
Figure 3B:
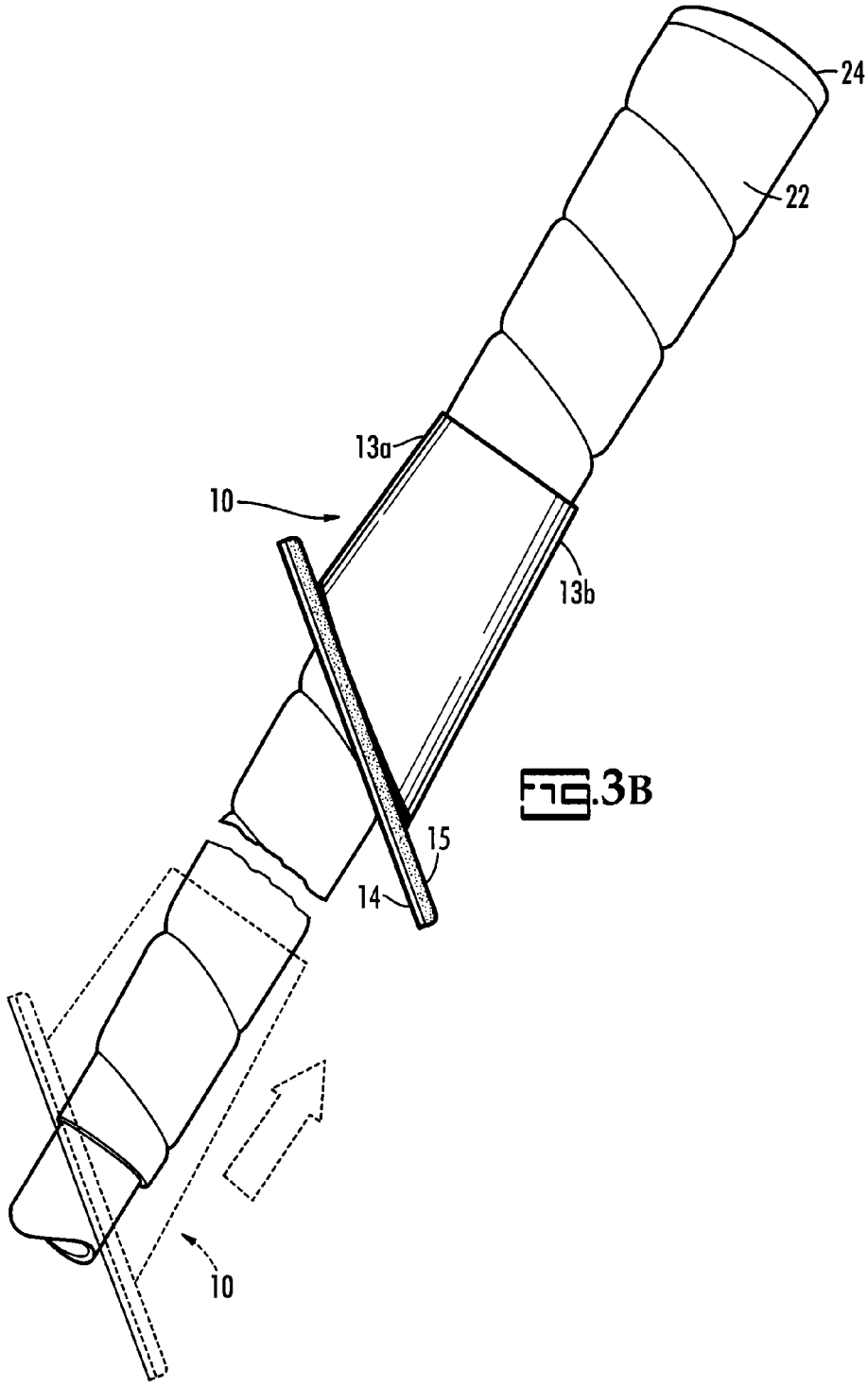
FIG. 3B illustrates placement of the implement on the grip in another configuration.

Referring now to FIG. 2B, implement 10 is next slid upward along the length of the golf club shaft away from narrow portion 18 towards the club grip 22. The dimensions and shape of tapered sleeve 12 are such that implement 10 comes to rest in a position along the upper portion of a standard club grip 22 as shown in FIGS. 3A and 3B. The orientation of implement 10 may be varied for multiple uses as discussed further below.

FIG. 3A illustrates the example embodiment for promoting a loose grip when used by a golfer. In this particular example configuration of implement 10 on grip 22, the upper portion 13*a* of tapered sleeve 12 is oriented towards the rear of the golf club-towards the golfer-while lower portion 13*b* is oriented towards the front of the golf club. In this manner, circumferential guard 14 is angled substantially 45 degrees upward from upper portion 13*a* to lower portion 13*b*. In other words, and as shown in FIG. 3A, the guard 14, which is attached at one end of the tapered sleeve 12, is oriented at an angle so that the sleeve 12 has a longer side (see at 13*b*) on one side thereof and hence club grip 22, and a shorter side (see at 13*a*) on the opposite side thereof and hence grip 22.

Figure 4A:
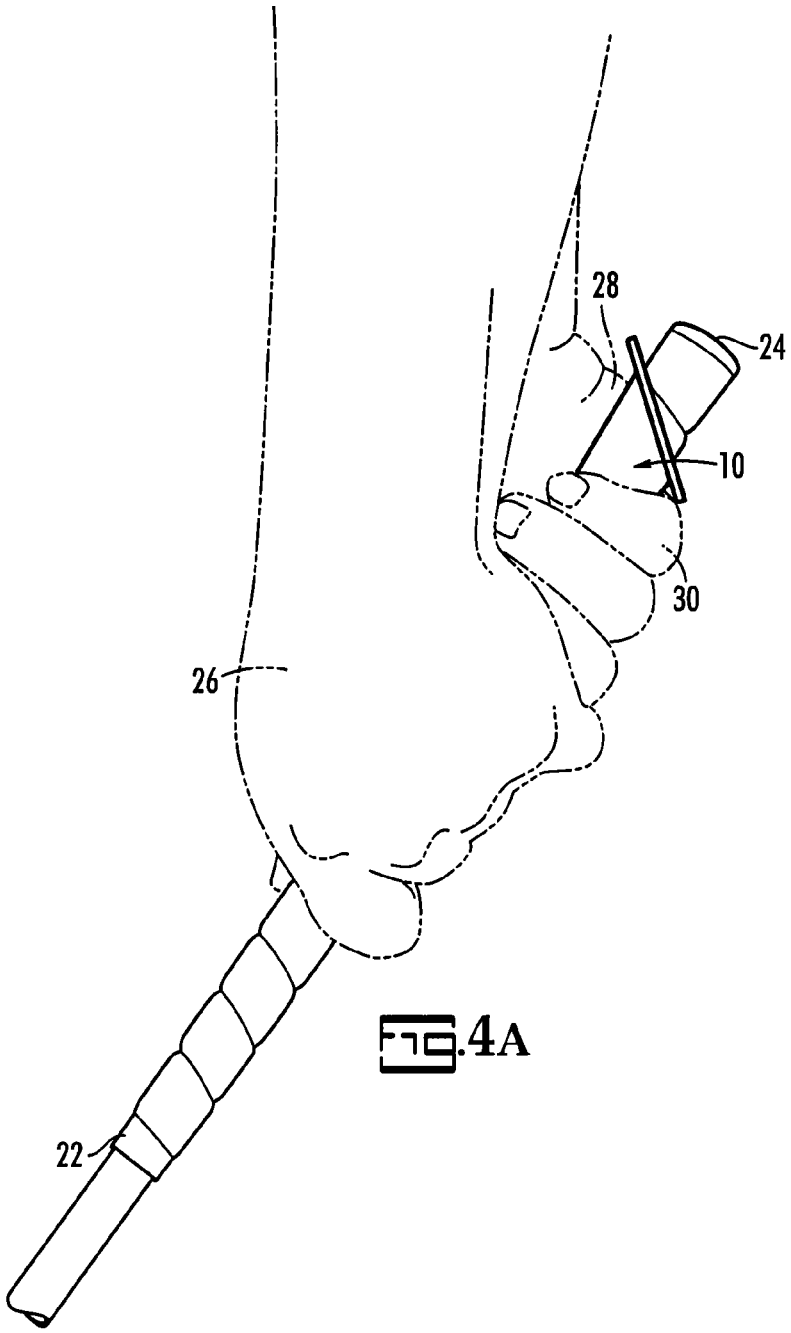
FIG. 4A illustrates use of the golf training implement in one configuration on the grip.

As further illustrated in FIG. 4A, this configuration of implement 10 on grip 22 causes the small finger 30 of the golfer's upper hand 28 to rest against circumferential guard 14 closer to the top 24 of the golf club in a substantially optimal position to aid a normal golf swing. The addition of implement 10 prevents the golfer's hands 26 and 28 from sliding further upward on the golf club and thereby tends to cause the golfer to grip the club more loosely in normal use. Studies show that a looser grip tends to lessen the tendency of a golfer to exhibit a "slice" swinging motion. As the golfer grows more confident that a looser grip is sufficient to hold the club properly, the "slice" swing may disappear altogether and a more preferable "draw" swinging motion may appear.

Figure 4B:
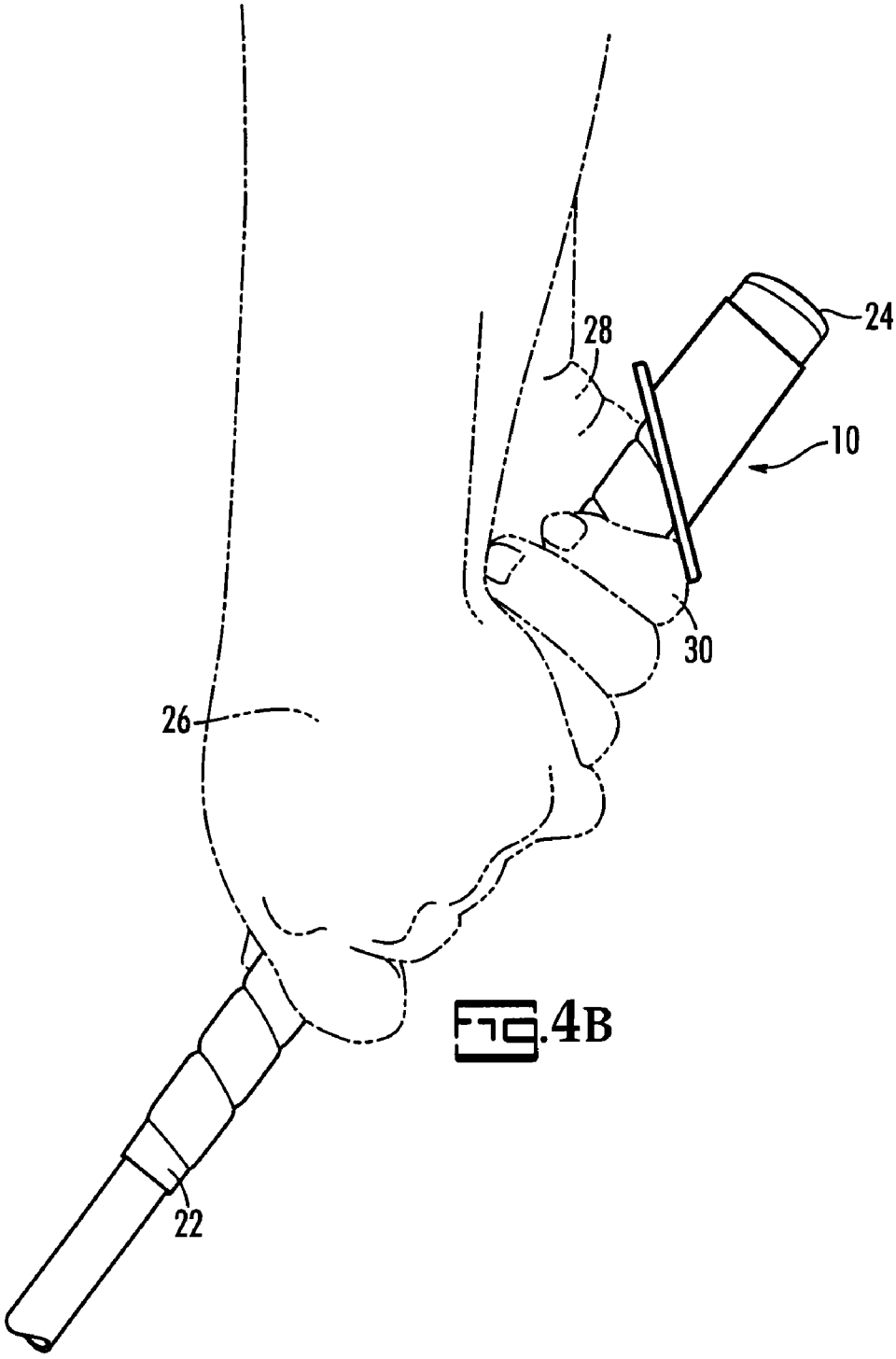
FIG. 4B illustrates use of a golf training aid implement in another configuration on the grip.

Flipping implement 10 over can serve another function as shown in FIGS. 3B and 4B. As implement 10 is held in place by club-to-implement friction resulting from correct sizing of the sleeve portion when placed around a standard golf club grip 22, implement 10 may be easily flipped 180 degrees about grip 22. Referring now to FIG. 3B, implement 10 has been flipped 180 degrees about the surface of golf club grip 22 so that the tapered sleeve 12 is now above circumferential guard 14. In this particular configuration, circumferential guard 14 remains angled substantially 45 degrees upward, but now that angle is accomplished by rotating circumferential guard 14 about grip 22 so that guard 14 angles upward from lower portion 13*b* to upper portion 13*a*. Now, however, circumferential guard 14 is oriented or angled away from the top 24 of the club. This configuration of the implement 10 moves the circumferential guard 14 down along the length of the grip 22, thereby forcing the golfer's hands 26 and 28 further down grip 22 away from the top 24 of the club. Commonly known as "choking-up" on the club grip 22, this action allows golfers to practice this vital technique for reducing club speed for shorter and more carefully placed golf shots.

Other uses for implement 10 are illustrated in FIGS. 4A and 4B. For example, placement and use of implement 10 as shown in FIG. 4A improves a golfer's grip on a golf club. This can be useful in many situations. A worn club grip 22 can be very slippery. Golfers may also find that golfing in the heat or rain results in slippery hands and may then tend to compensate by over-gripping the club, resulting in an unwanted "slice" swinging motion. The same results can be observed in golfers with physical difficulties or low-strength grip resulting from conditions such as arthritis. Use of implement 10 as shown in FIGS. 4A and 4B prevents club slippage and thereby allows a golfer to maintain a proper grip, which in turn improves the golfer's swing.

Figure 5:
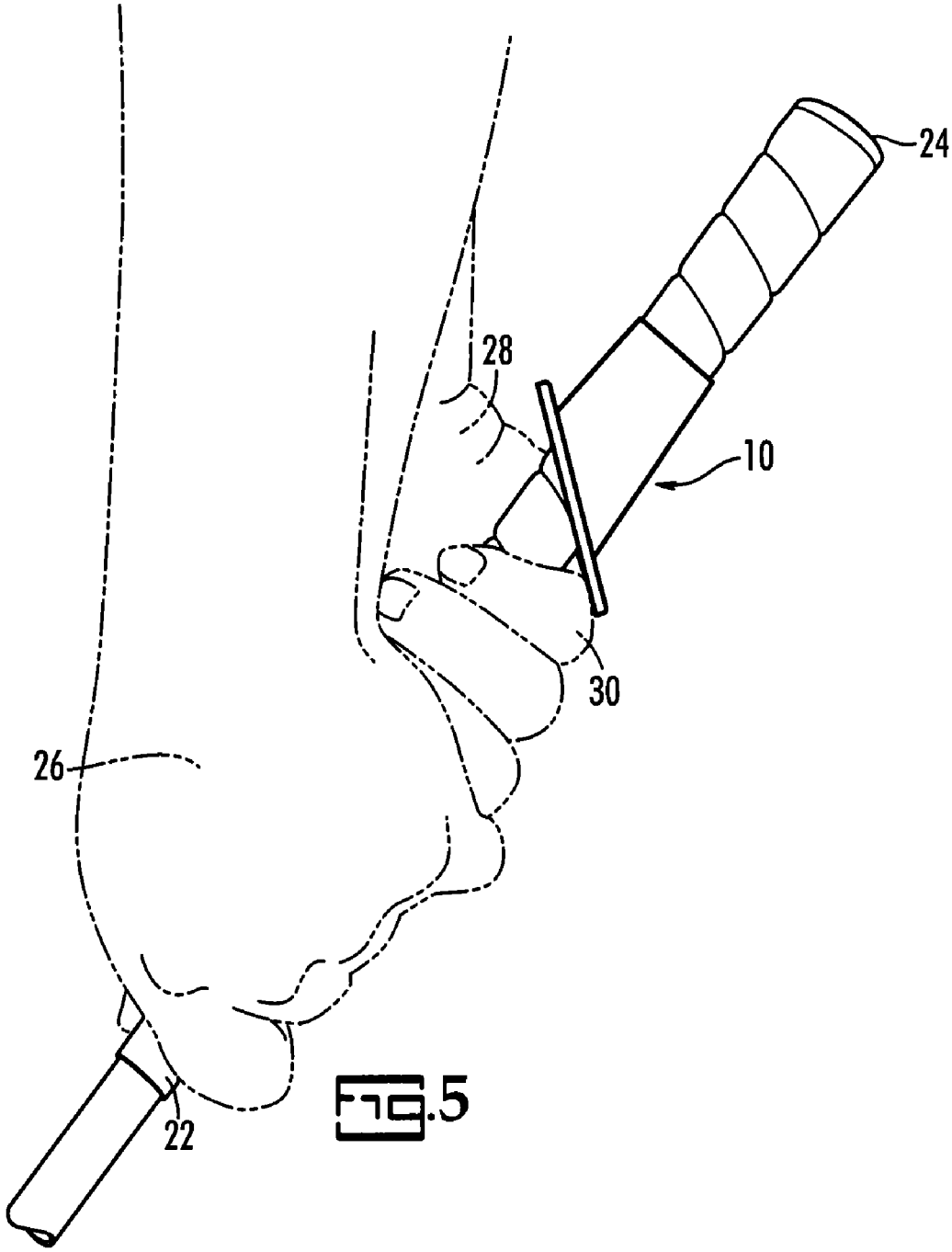
FIG. 5 illustrates use of the implement in a choking-up configuration on the grip.

Referring now to FIG. 5, implement 10 is shown in use to force a golfer to further "choke-up" on the club grip 22. Implement 10 may be composed of a malleable material so that its c-shaped tapered sleeve 12 may expand and contract to hold implement 10 in place by compression and friction wherever located on club grip 22. One embodiment of implement 10 with the properly sized tapered sleeve 12 allows use at any point along the length of a standard grip 22. Here again, the circumferential guard 14 is angled substantially 45 degrees upward from lower portion 13*b* (the longer side of sleeve 12 or first side) to upper portion 13*b* (shorter side of sleeve 12 or second side) as shown in FIG. 3B. A golfer may practice and perform more advanced choking-up swings in this manner by moving implement 10 further down club grip from the top 24 of the golf club as shown in FIG. 5.

The example embodiment being thus described, it will be obvious that the same may be varied in many ways. Such variations are not to be regarded as departure from the example embodiment, and all such modifications as would be obvious to one skilled in the art are intended to be included in the following claims.

The invention claimed is:

1. A golf club training implement, comprising:

a tapered sleeve having a wider diameter at a first end and a smaller diameter at a tapered second end, the tapered sleeve configured to slidably fit along a golf club grip, the sleeve including a longitudinal slit opening so that the implement is fitted over a narrower portion of a golf club lower shaft and moved up along the shaft's length until secured on the golf club grip, and a substantially circular guard portion attached at the sleeve first end, the slit opening also extending therethrough, the guard portion encircling the golf club grip, the guard portion oriented at an angle relative to the sleeve first end so that the sleeve has a longer first side along the grip and an opposite shorter second side along the grip between the sleeve first and second ends to substantially prevent slippage of the golf club from a golfer's grip.

2. The implement of claim 1, wherein the guard portion is angled substantially 45 degrees from a perpendicular line through a longitudinal axis on which the shaft, grip and tapered sleeve extends.

3. The implement of claim 1, wherein the sleeve is reversible in a 180 degree angle on the grip, and the guard portion is angled substantially 45 degrees from a perpendicular line through the longitudinal axis on which the shaft, grip and tapered sleeve extends.

4. The implement of claim 1, the implement being adapted to be slidably adjusted between one of upper, middle, and lower portions of the golf club grip without removing it from the grip.

5. The implement of claim 1, further comprising a layer of padding on a surface of the substantially circular guard portion to abut a pinky finger of a rear hand of the golfer on the grip.

6. A method of fabricating a golf club training implement, comprising:

forming a tapered sleeve having a wider diameter at a first end and a smaller diameter at a tapered second end, forming a longitudinal slit opening in the sleeve, the formed tapered sleeve with longitudinal slit configured to be fitted over a portion of a golf club shaft and slidably fit along a golf club grip, and forming a substantially circular guard portion on the sleeve first end, forming the guard portion further including:

forming a slit opening in the guard portion aligned with the longitudinal slit opening in the sleeve, the formed guard portion configured to encircle the golf club grip, and orienting the formed guard portion at an angle relative to the sleeve first end so that the formed sleeve with guard portion thereon has a longer first side and an opposite shorter second side between the sleeve first and second ends.

7. A golf club training implement, comprising:

a tapered sleeve having a first end, a tapered second end, and a longitudinal slit opening therein so that the implement fits over a shaft of a club for slidable placement on or along a golf club grip, and a substantially circular guard attached to and abutting the sleeve first end, the guard oriented at an angle relative to the sleeve first end so that the sleeve has a longer first side and an opposite shorter second side between the sleeve first and second ends.

8. The implement of claim 7, wherein the guard is angled substantially 45 degrees from a perpendicular line through a longitudinal axis on which the shaft, grip and tapered sleeve extends.

9. The implement of claim 7, wherein the sleeve is reversible in a 180 degree angle on the grip, and the guard is angled substantially 45 degrees from a perpendicular line through a longitudinal axis on which the shaft, grip and tapered sleeve extends.

10. The implement of claim 7, further comprising a layer of padding on a surface of the substantially circular guard.

* * * * *